United States Patent [19]

Koskela

[11] Patent Number: 4,631,842

[45] Date of Patent: Dec. 30, 1986

[54] SPORT SHOE SOLE PROVIDED WITH PEDESTALS

[76] Inventor: Tauno Koskela, Kaskitie 19, 00630 Helsinki 63, Finland

[21] Appl. No.: 763,438

[22] PCT Filed: Nov. 28, 1984

[86] PCT No.: PCT/FI84/00090

§ 371 Date: Jul. 29, 1985

§ 102(e) Date: Jul. 29, 1985

[87] PCT Pub. No.: WO85/02327

PCT Pub. Date: Jun. 6, 1985

[30] Foreign Application Priority Data

Nov. 28, 1983 [FI] Finland ..... 834351

[51] Int. Cl.[4] ..... A43B 13/00; A43B 13/24

[52] U.S. Cl. ..... 36/103; 36/59 R; 36/67 R; 36/134

[58] Field of Search ..... 36/134, 59 R, 59 A, 36/59 B, 59 C, 59 D, 67 R, 67 A, 67 D, 32 R, 103, 134

[56] References Cited

U.S. PATENT DOCUMENTS

| | | | |
|---|---|---|---|
| 509,927 | 12/1893 | Mayer | 36/59 R |
| 3,170,251 | 2/1965 | Patrick . | |
| 4,041,619 | 8/1977 | Sapper | 36/103 |
| 4,241,523 | 12/1980 | Daswick | 36/32 R |
| 4,318,232 | 3/1982 | Ching | 36/59 B |
| 4,348,821 | 9/1982 | Daswick | 36/32 R |

FOREIGN PATENT DOCUMENTS

| | | | |
|---|---|---|---|
| 270448 | 4/1969 | Austria | 36/59 C |
| 770692 | 7/1934 | France | 36/67 A |
| 1355675 | 6/1974 | United Kingdom | 36/67 A |
| 1490219 | 10/1977 | United Kingdom | 36/32 R |

*Primary Examiner*—James Kee Chi

*Attorney, Agent, or Firm*—Burns, Doane, Swecker & Mathis

[57] ABSTRACT

Sport shoe sole provided with either stationary or replaceable obstacles, and more specifically to the sole of a sport shoe designed for running or jogging. The obstacles are located in the sole construction in the region between the point of support (C) of the ball of the foot and the center of gravity (P') of the heel. The moment arm (x2) of the foot is shorter than the respective moment arm (x1) with an ordinary sport shoe. This saves energy, and the dynamic resistance of the calf and the Achilles tendon with each step is reduced in comparison to the prior art, so that the running proceeds economically and effectively. The heel platform located behind the center of gravity (P') of the heel is lowered down, in which case the moment arm (x3) of the heel is eliminated, and the front muscle of the lower leg is released from unnecessary strain.

16 Claims, 6 Drawing Figures

SPORT SHOE SOLE PROVIDED WITH PEDESTALS

FIELD OF THE INVENTION

The present invention relates to a sport shoe sole provided with obstacles.

BACKGROUND OF THE INVENTION

In the prior art there are known sport shoe sole constructions which are provided all the way from toe to heel with some sort of fixed pedestals, such as grooves which are transversal with respect to the proceeding direction, and/or bulges or various different studs or stud-like members located adjacent to each other, and the heel platform proper. Such sole constructions are not particularly well suited for jogging or running exercises. They cause multiple strain in the legs and feet which may easily become sore.

Spikes, studs and other similar pedestals are normally attached to sport shoe soles by means of suitable fastener plates or by screwing them into screw sockets located in the sole. The sole, and consequently the whole shoe, becomes relatively heavy owing to this kind of fastening methods. Moreover, the shoe has to be manufactured in several stages which results in a high price.

Spikes or studs provided with a suitable fastener flange can be attached by pushing them into small pockets which are arranged in the shoe sole. The drawback with this type of sport shoe is the special structure of the sole and the resulting demands set for the spikes or the like—for example the necessity to provide a stiff fastening flange.

SUMMARY OF THE INVENTION

The aforementioned drawbacks can be avoided by employing the sport shoe sole of the present invention, where the sole is provided with either stationary or replaceable pedestals.

The sport shoe sole provided with pedestals, according to the present invention, is particularly well suited to a running or jogging shoe. The pedestals are positioned within the area between the point of support of the ball of the foot and the centre of gravity of the heel, or at least around the border region of this area in the vicinity of the said points; consequently, the legs and feet, while running, are not strained to the same extent as before.

A preferred embodiment of the sole construction renders the possibility to match the pedestals in suitable locking grooves located in the sole, and the particular grooves employed each time can be individually chosen. After testing, each user can place the obstacles so that the dynamic strain in the calves and in the Achilles tendons is as small as possible while running. The flexibility and attenuation properties of the shoe can also be affected by modifying the nature of the pedestals. Moreover, the pedestal or pedestals belts can easily be changed according to the terrain (gravel road, asphalt), weather conditions (rain, sunshine) or the season, and thus the shoes always have the best possible grip. The pedestals also prevent the shoes from wearing out too quickly.

BRIEF DESCRIPTION OF THE DRAWING

In the following preferred embodiments of the present invention are explained in detail with reference to the appended drawings, wherein.

DETAILED DESCRIPTION OF THE PREFERRED EMBODIMENTS

Figure 1:
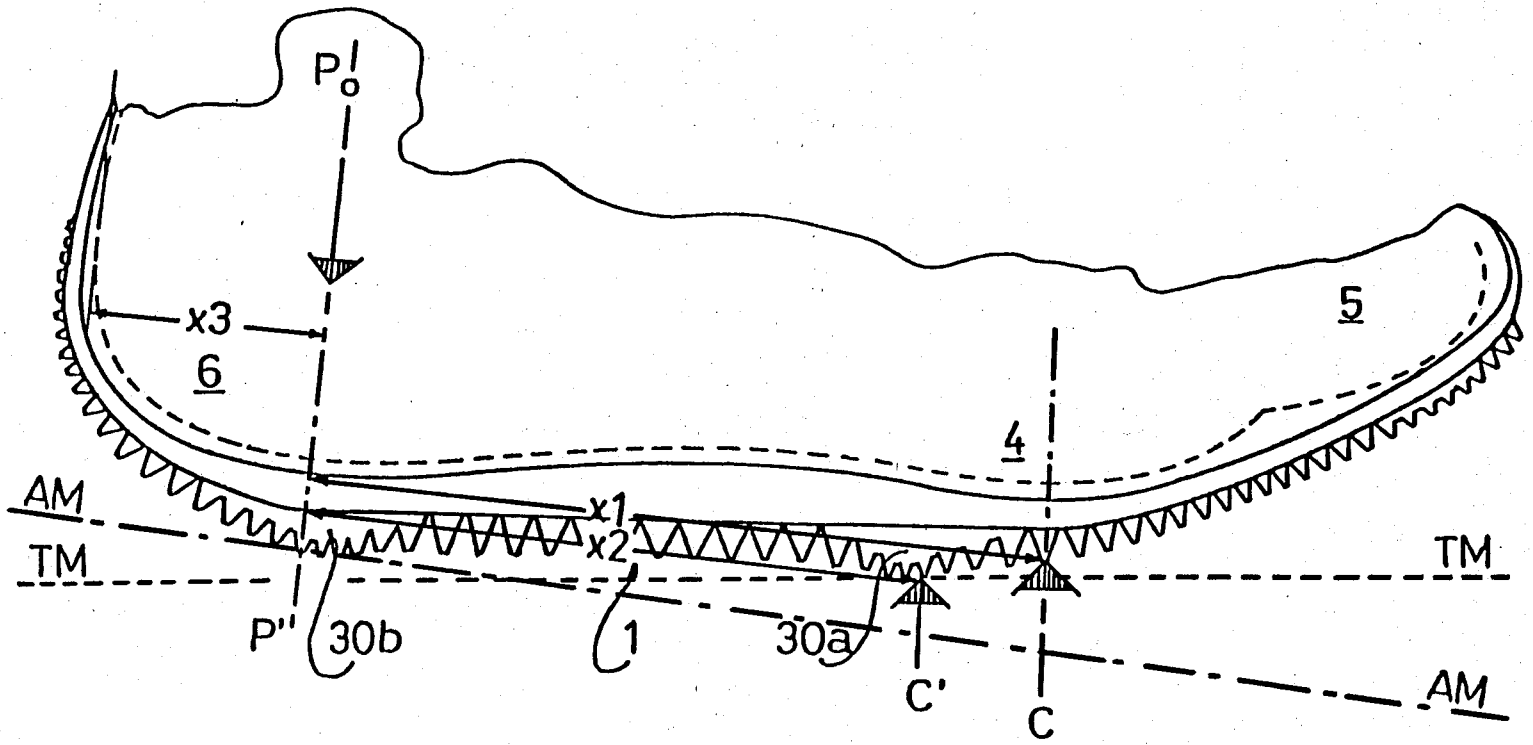
FIG. 1 is a sectional side view of the sport shoe sole of a preferred embodiment of the invention, provided with fixed pedestals.
Figure 2:
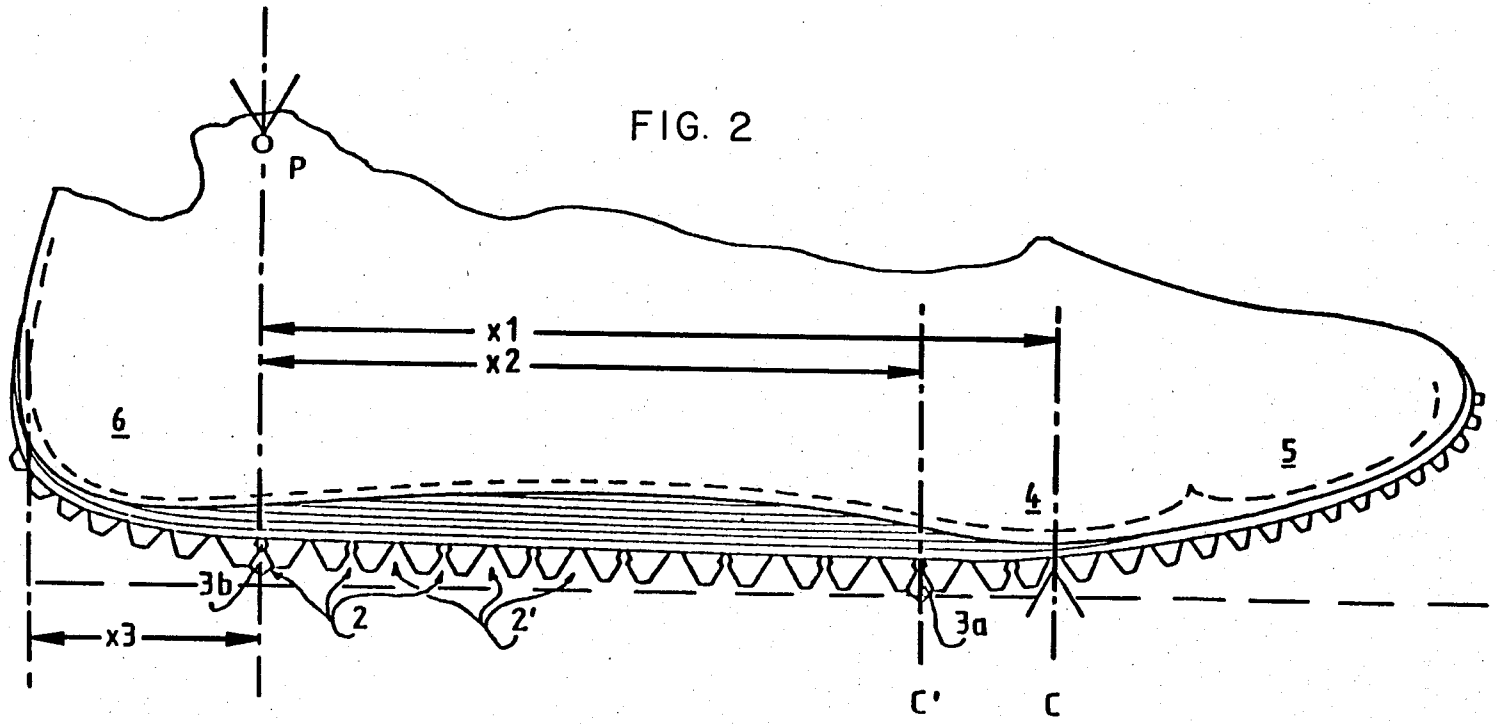
FIG. 2 is a sectional side view of the sport shoe sole of a second preferred embodiment the invention, provided with replaceable pedestals.

The whole area of the sport shoe sole 1 can be provided with pedestals, such as transversal grooves 2' or corrugations, as is seen in FIGS. 1 and 2. When a person, after putting the sport shoes on, remains standing in attention position, the centre of gravity of the body falls on the vertical line PP' drawn via the ankle bone (malleolus medialis), wherein P' refers to the centre of gravity of the heel. While walking or running barefooted or with ordinary (sport) shoes, the point of support C of the foot is at the ball of the foot 4, near the toes 5. In FIGS. 1 and 2, the distance between the centre of gravity of the heel and the point of support of the ball of the foot, i.e. the moment arm of the foot, is indicated with the symbol x1.

In the sport shoe sole of the invention, the pedestal or group of pedestals 30*a*, which is positioned between the centre of gravity of the heel P' and the support point of the ball of the foot C, so that it is advantageousy located 10 . . . 25% nearer to the centre of gravity of the heel with respect to the distance x1, is formed so that it is at least partly protruding as compared to the rest of the sole which conforms to the form of the sole of the foot. Thus a new point of support C' for the ball of the foot is obtained, and the distance between the centre of gravity P' and the point of support C', i.e. the moment arm of the foot, is reduced to x2.

While walking or running barefooted, the moment arm of the foot of a normal-sized person is x1~150 mm in average. While employing the sole construction of the invention, the moment arm can be reduced for instance to x2~125 mm. This reduces the dynamic strain in the calf and the Achilles tendon about 5–10 kp with each step and consequently helps to save energy, so that an economical and effective running technique can be achieved. In FIG. 1, the line TM—TM describes the ground surface with respect to the sport shoe in dashes and in speed running.

The sole construction of the invention is advantageously suited for realizing a lowered-down heel platform. This is achieved so that the pedestal or group of pedestals 30*b*, which is located in the immediate vicinity of the centre of gravity P' of the heel, is mainly formed to protrude from the rest of the sole construction, in similar fashion as above, at the point of support C' of the ball of the foot. Now the moment arm x3 between the centre of gravity P' and the heel is eliminated. Consequently the front muscle of the lower leg (musculus tibialis anterior) is released from unnecessary strain and loss of energy. The heel platform does not disturb the step, particularly on a downhill track (line AM—AM, FIG. 1), but now the steps flow fluently to their full length. Simultaneously the workin area of the foot and the calf is extended, and the step becomes longer.

Those pedestals that are located at the border region between the centre of gravity P' of the heel and the new point of support C' of the ball of the foot, can also be partly or wholly formed so that they are protruding members with respect to the rest of the sole, i.e. the heel and the toe. These pedestals do not extend further than to the same level as the pedestals 30*a*, 30*b* located in the immediate vicinity of the centre of gravity P' and the point of support C'.

In FIG. 2, it is schematically illustrated how, according to a preferred embodiment of the invention, the sole 1 of a sport shoe is provided with locking grooves 2 positioned transversally with respect to the heel-toe line; these locking grooves can be provided with replaceable pedestals 3. The locking grooves 2 may extend over the whole sole, as is seen in FIG. 2, or the grooves 2 may be closed at the sole edges. In the lengthwise direction of the shoe, every second groove can be an ordinary groove 2', while the rest of the grooves are locking grooves 2.

Figure 3:
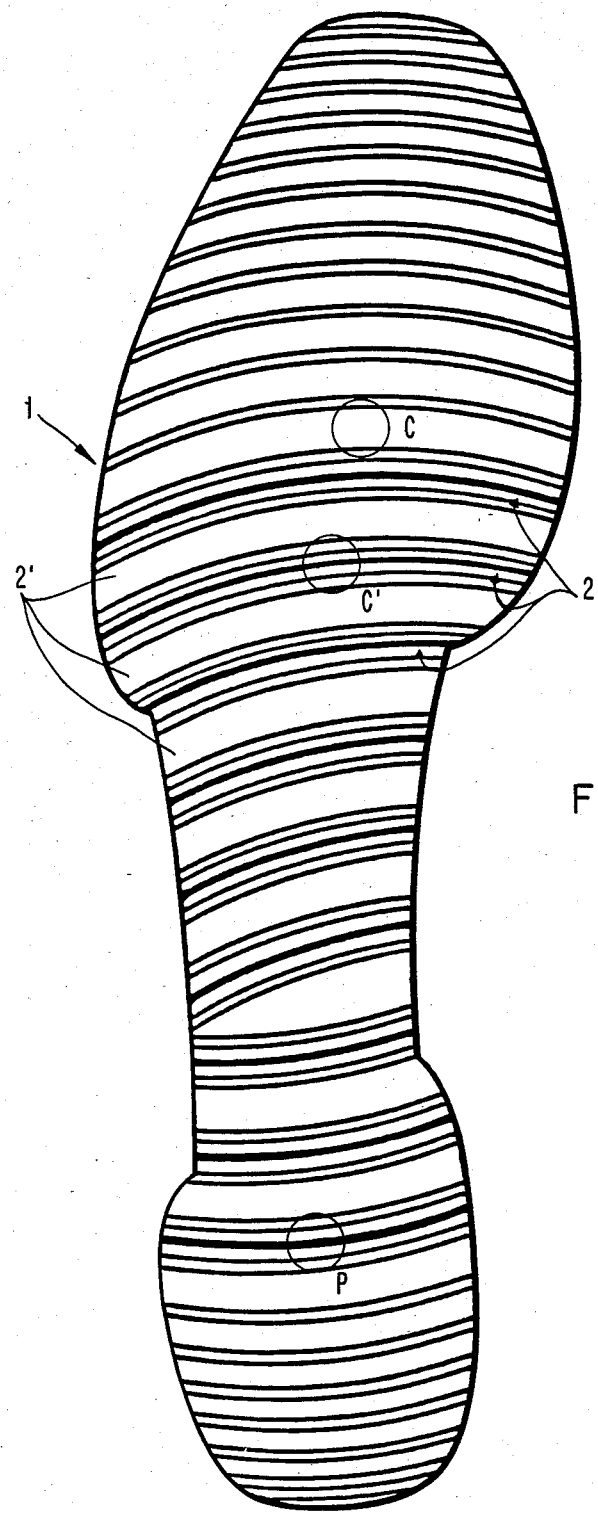
FIG. 3 is a bottom view of the sport shoe sole of FIG. 2.

The locking grooves 2 are positioned in the sole in the region between the point of support C of the ball of the foot and the centre of gravity P' of the heel. According to the basic principle of the invention, the point of support C of the ball of the foot can be shifted to a desired point C' by fixing the pedestals 3*a* to a suitable locking groove 2. In addition to this, the grooves 2 can be made suitably curved, as is illustrated in FIG. 3: on the side of the ball of the foot, they are made convex in the toe direction, and on the side of the heel they are made concave respectively. The locking groove 2 has a V-shaped cross-section (FIG. 4*a*), or respectively it is gradually narrowing towards the inside of the sole (FIG. 4*b*), and at the bottom thereof there is arranged a suitable cavity or extension 21 which is parallel to the groove.

Figure 5:
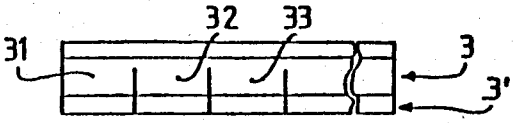
FIG. 5 is a partial sectional view of the locking groove and obstacle of FIG. 4*a* along the line A—A.
Figure 4B:
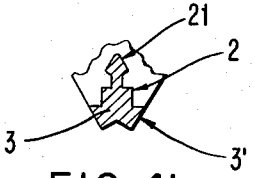
FIGS. 4*a* and 4*b* are detailed views of two different locking groove arrangements for a sport shoe, as well as of the pedestals matched in the respective grooves
Figure 4A:
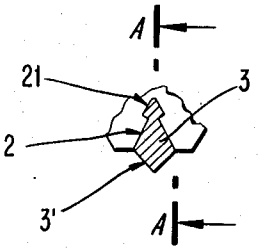

The stems of the pedestals 3 are formed to match the locking grooves 2 as is shown in FIGS. 4*a* and 4*b*, so that they can easily be pressed into the grooves 2 or removed from the grooves 2. The tips 3' of the pedestals 3 can be suitably designed to serve different purposes; they can be for example arrow-heads (FIG. 4*a*) and provided with one or two ridges (FIG. 4*b*). They can also be provided with reinforcements. The pedestals 3 can be made of the same material as the sole, but advantageously they are made of a material harder than the sole material. The pedestals 3 which are matched into the locking groove 2 are advantageously formed of a uniform, flexible belt or a similar arrangement with interconnected adjacent members 31, 32, 33 . . . as is shown in FIG. 5.

By employing the sole construction described above, it is advantageous to realize the lowered-down heel platform: an pedestal belt 3*b* is simply matched in the locking groove of the sole, at the spot where the line PP', drawn via the ankle bone P and the centre of gravity P', intersects the sole. This operation eliminates the moment arm x3 of the heel.

When obstacles and pedestal belts are attached to the transverse grooves 2 or corrugations formed in the sport shoe sole, so that the pedestals can be changed according to the weather, the terrain and/or the season, a decisive influence as regards the grip of the shoe can be achieved. For example, the pedestal belts employed in wintertime may comprise steel tacks at suitable intervals in order to improve the grip while running on icy roads. With a dense groove system, the shoe is made flexible and light. In order to prevent the runner form sliding sideways, and in order to improve the support required by the shoelacing, the grooves 2, 2' in the sole can be made suitably curved, i.e. arching.

In the above specification, the invention has been explained mainly with reference to a few preferred embodiments. It is to be understood that the invention can be modified in many ways without departing from the inventive idea expressed in the patent claims. For example, the fixed pedestal or groups of pedestals 30*a*, 30*b*, can be studs or the like which are suitably placed in the sport shoe sole 1.

The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. In a shoe sole of the type comprising a bottom portion having a first point located beneath a center of gravity of a wearer's heel and a second point of support for the wearer's ball of foot, said first and second points spaced a first distance apart, said bottom portion in a region between said first and second points generally conforming with the sole of the wearer's foot, the improvement comprising a first pedestal extending downwardly from said bottom portion at a location adjacent said second point but nearer to said first point than said second point by a second distance equal to 10 to 25 percent of said first distance so that the moment upon the wearer's foot is reduced during running.

2. The shoe sole according to claim 1, the improvement further comprising a second pedestal extending downwardly from said bottom portion at said first point.

3. The shoe sole according to claim 2, wherein said bottom portion includes toe and heel regions which are each raised relative to said region between said first and second points.

4. The shoe sole according to claim 2, wherein said pedestals are positioned in said bottom portion in an arched fashion with respect to the lengthwise direction of said shoe sole.

5. The shoe sole according to claim 2, wherein said bottom portion is provided with a plurality of transverse locking grooves, said first and second pedestals comprising members adapted to be replaceably attached in said locking grooves.

6. The shoe sole according to claim 5, wherein every second groove in the lengthwise direction of the shoe sole is a non-locking groove and the remainder of the grooves are locking grooves.

7. The shoe sole according to claim 5, wherein each locking groove converges in an upward direction into said bottom portion and an upper part of each locking groove is provided with an extension.

8. The shoe sole according to claim 5, wherein said pedestals are formed of a uniform belted arrangement of interconnected members.

9. The shoe sole according to claim 8, wherein a tip region of the pedestal has an arrow-shaped cross-section.

10. The shoe sole according to claim 8, wherein a cross-section of a tip region of the obstacle is arrow-shaped and includes two ridges.

11. The shoe sole according to claim 2, wherein said pedestals are positioned in said bottom portion in an arched fashion with respect to the lengthwise direction of said shoe sole.

12. The shoe sole according to claim 2, wherein said bottom portion is provided with a plurality of transverse locking grooves, said first and second pedestals comprising members adapted to be replaceably attached in said locking grooves.

13. The shoe sole according to claim 4, wherein said bottom portion is provided with a plurality of transverse locking grooves, said first and second pedestals comprising members adapted to be replaceably attached in said locking grooves.

14. The shoe sole according to claim 6, wherein each locking groove converges in an upward direction into said bottom portion and an upper part of each locking groove is provided with an extension.

15. The shoe sole according to claim 6, wherein said pedestals are formed of a uniform belted arrangement of interconnected members.

16. The shoe sole according to claim 7, wherein said pedestals are formed of a uniform belted arrangement of interconnected members.

* * * * *